US009905898B2

(12) United States Patent
Hirata

(10) Patent No.: US 9,905,898 B2
(45) Date of Patent: Feb. 27, 2018

(54) DIGITALLY TUNABLE COAXIAL RESONATOR REFLECTIVE BAND REJECT (NOTCH) FILTER

(71) Applicant: Lark Engineering, Anaheim, CA (US)

(72) Inventor: Francisco Iwao Hirata, San Diego, CA (US)

( * ) Notice: Subject to any disclaimer, the term of this patent is extended or adjusted under 35 U.S.C. 154(b) by 0 days.

(21) Appl. No.: 14/946,667

(22) Filed: Nov. 19, 2015

(65) Prior Publication Data

US 2017/0149109 A1 May 25, 2017

(51) Int. Cl.
*H01P 1/202* (2006.01)

(52) U.S. Cl.
CPC ..... *H01P 1/202* (2013.01)

(58) Field of Classification Search
CPC ..... H01P 1/202; H01P 1/201; H01P 1/205; H01P 1/2053
USPC ..... 333/202, 206, 207, 222, 223
See application file for complete search history.

(56) References Cited

U.S. PATENT DOCUMENTS 5,227,748 A * 7/1993 Sroka ..... H01P 1/202 333/207
6,307,448 B1 * 10/2001 Atokawa ..... H01P 1/2136 333/103
6,308,051 B1 * 10/2001 Atokawa ..... H01P 1/213 333/207
2002/0030556 A1 * 3/2002 Yamada ..... H01P 1/2056 333/134
2004/0183626 A1 * 9/2004 Kang ..... H01P 1/2056 333/207

* cited by examiner

*Primary Examiner* — Stephen E Jones
(74) *Attorney, Agent, or Firm* — Elizabeth Yang

(57) ABSTRACT

A coaxial tunable band stop filter utilizes tuning elements, such as PIN diodes and varactor diodes, for electrically tuning a coaxial resonator to change the resonance frequency of the coaxial resonators. A voltage is applied to the tuning elements to change their capacitance, such that they electrically lengthen and shorten the coaxial resonator. The variable voltages work to change the center frequency across a bandwidth. When the resonators are electrically extended or shortened in length, the center frequency in the bandwidth is changed accordingly. The bandwidth for the coaxial tunable band stop filter is tunable to increase and decrease based on the position of the center frequency. A ninety degree transmission line is used for coupling the components of the filter. A digital control is used for manipulating the tuning elements.

20 Claims, 5 Drawing Sheets

DIGITALLY TUNABLE COAXIAL RESONATOR REFLECTIVE BAND REJECT (NOTCH) FILTER

FIELD OF THE INVENTION

The present invention relates generally to a coaxial tunable band stop filter that utilizes tuning elements, such as PIN diodes and varactor diodes, for electrically tuning a coaxial resonator to change the resonance frequency of the resonators; whereby a voltage is applied to the tuning elements to change their capacitance, such that they electrically lengthen and shorten the coaxial resonator; whereby the voltage varies the center frequency of the bandwidth.

BACKGROUND OF THE INVENTION

It is generally known that a band stop filter is configured to pass most frequencies through a bandwidth unaltered, but attenuates those in a specific range to very low levels. It is also known that a band-stop filter with a narrow stopband is a notch filter.

The present invention is directed to a coaxial tunable band stop filter utilizes tuning elements, such as PIN diodes and varactor diodes for tuning a coaxial resonator to change the resonance frequency of the resonators. A voltage is applied to the tuning elements to change their capacitance, such that they electrically lengthen and shorten the coaxial resonator. The voltage varies the center frequency of the bandwidth. When the resonators are electrically extended or shortened in length, the center frequency in the bandwidth is changed accordingly. The bandwidth for the coaxial tunable band stop filter is tunable to increase and decrease based on the position of the center frequency.

Generally, band stop filters require precise transmission characteristics to attenuate a band of frequencies at a specific bandwidth and to pass frequencies outside the bandwidth at both higher and lower frequencies. The band stop filters are generally characterized by a bandwidth, center frequency, insertion loss, selectivity or rejection, ripple and return loss. In one known parameter, the band stop filter may have a center frequency of 1000 MHz and bandwidth of 100 MHz or 950-1050 MHz.

Often, resonators have a resonance frequency that can be electronically controlled by means of varactors diodes, PIN diodes, MEMs, etc. The varactor diodes could include a tuning band extending beyond the very narrow limits usually obtainable with conventional networks.

It is known in the art that, conventional coupling network between a dielectric resonator and a varactor diode, both placed on the same face of a microstrip circuit, includes a length of 90° transmission line which is terminated at one side only, by means of the varactor diode and near to which the resonator is fixed. The control voltage is applied to the varactor diode through a suitable RF decoupling network.

In many instances, the transmission line and varactor diode assembly is dimensioned in such a way as to resonate at about the nominal frequency of the dielectric resonator. During the circuit operation, the magnetic field lines of the resonator interlink with the transmission line. By varying the bias voltage of the varactor diode, the capacitance of the latter is modified and the change of the resonance frequency of the dielectric resonator is thus determined.

Thus, an unaddressed need exists in the industry to address the aforementioned deficiencies and inadequacies in non-tunable filters. Even though the above cited methods for band stop filters meets some of the needs of the market, a coaxial tunable band stop filter that is electrically tunable through tuning elements, such as PIN diodes and varactor diodes is still desired.

SUMMARY OF THE INVENTION

The present invention is directed to a coaxial tunable band stop filter that utilizes tuning elements, such as PIN diodes and varactor diodes for electrically tuning a plurality of coaxial resonators to change the resonance frequency of the coaxial resonators. A voltage is applied to the tuning elements to change their capacitance, such that they electrically lengthen and shorten the coaxial resonator. The variable voltages work to change the center frequency across a bandwidth.

The novelty of the present invention is that the tuning elements are electrically manipulated to tune the coaxial resonator. Additional novelty is that the tuning elements are manipulated electrically, not manually, to tune the coaxial resonator. Additional novelty is found in that instead of an inductor, a coaxial resonator is tuned.

The coaxial tunable band stop filter is composed of a plurality of coaxial resonators, a plurality of tuning elements, an inductive coupling, a 90° transmission lines (90° TL), and a control circuitry. The coaxial resonators can be implemented using different dielectric materials such as: Air, Teflon, high Q ceramic materials, etc.

The tuning element can be implemented using varactors diodes, PIN diodes, MEMS, FETs, and CMOS switches. In any case, the capacitance is changed electronically, not manually. In one embodiment, a ninety degree transmission line is used for coupling the components of the filter. A digital control is used for manipulating the tuning elements. A coupling loss member is integrated into the filter for improving the coupling return loss.

By varying the voltage to the tuning elements, the capacitance changes. By applying variable voltages to the tuning elements, the length of the coaxial resonators may be electrically lengthened and shortened. When the coaxial resonators are electrically extended or shortened in length, the center frequency in the bandwidth is changed accordingly. The bandwidth for the tunable band stop filter is tunable to increase and decrease based on the position of the center frequency.

One objective of the present invention is to change the capacitance by electrically manipulating tuning elements, such as PIN diodes and varactor diodes in a reflective high Q tunable filter.

Yet another objective is to apply a bias voltage on the tuning elements to alter their capacitance.

Yet another objective is to provide cost effective and efficient coaxial band stop frequency filters.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 4A shows a diagram of the coupled line band stop frequency filter, and FIG. 4B shows a graph of the frequency response, in accordance with an embodiment of the present invention.

Like reference numerals refer to like parts throughout the various views of the drawings.

DETAILED DESCRIPTION OF THE INVENTION

Figure 1:
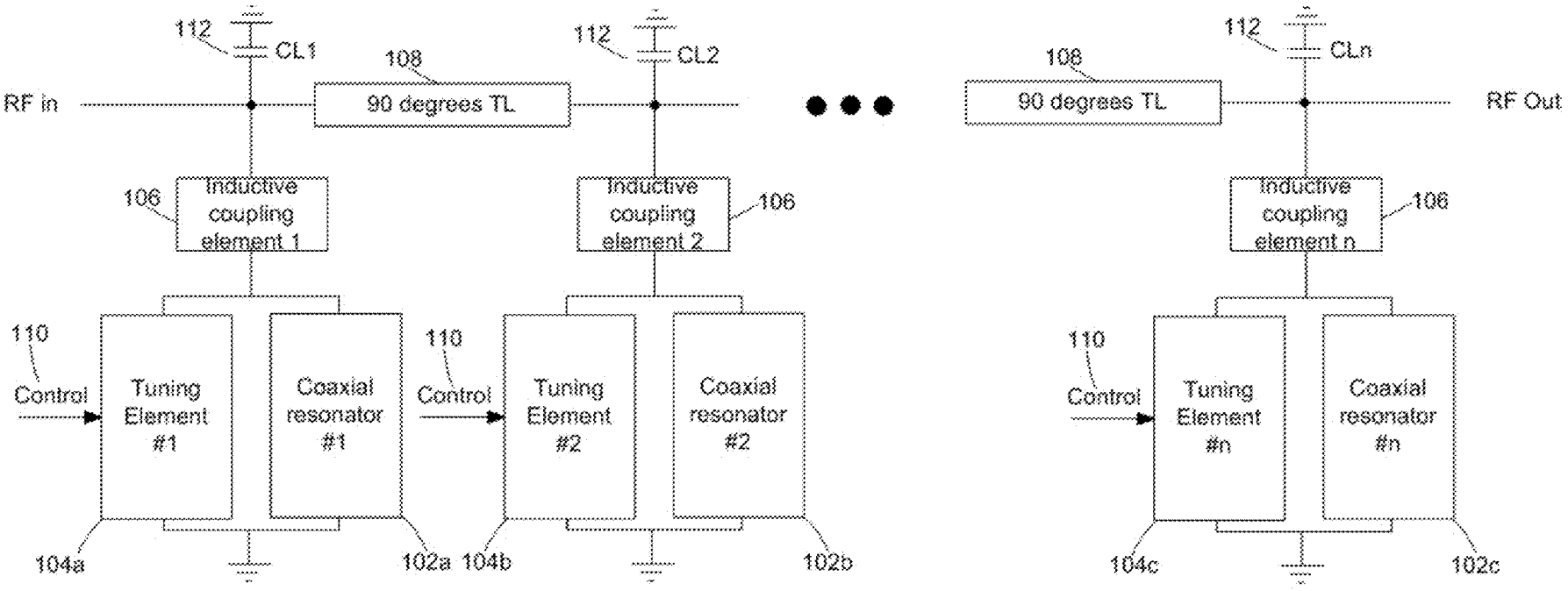
FIG. 1 illustrates a diagram of an exemplary coaxial band stop frequency filter, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention presented in FIGS. 1-4B, a coaxial tunable band stop filter 100 utilizes a plurality of tuning elements 104*a-c*, such as pin diodes and varactor diodes, for electrically tuning a plurality of coaxial resonators 102*a-c* to change the resonance frequency of the coaxial resonators 102*a-c*. In operation, a voltage is applied to the tuning elements 104*a-c* to change their capacitance, such that they electrically lengthen and shorten the coaxial resonator 102*a-c*. The variable voltages work to change the center frequency across a bandwidth.

The novelty of the present invention is that the tuning elements 104*a-c* are electrically manipulated to tune the coaxial resonators 102*a-c*. Additional novelty is that the tuning elements 104*a-c* are manipulated electrically, not manually, to tune the coaxial resonator. Additional novelty is found in that instead of an inductor, a coaxial resonator 102*a-c* is tuned. Thus, the present invention utilizes coaxial resonators 102*a-c* rather than an inductor, and tuning elements 104*a-c*, such as PIN diodes, rather than a fixed filter.

In one possible embodiment, the coaxial tunable band stop filter 100, hereafter, "filter 100" is composed of at least two coaxial resonators 102*a-c*, a plurality of tuning elements 102, an inductive coupling 106, a 90° transmission lines (90° TL) 108, and a digital control 110.

In one embodiment, the coupling element 106 can be implemented using a lumped element such an inductor. The center conductor of the coaxial resonator can be surrounded by air. The coaxial resonator 102*a-c* may include a circuit that is configured to reject frequencies in a specific band, while simultaneously admitting frequencies outside the band. In one embodiment, the coaxial resonators 102*a-c* can be implemented using different dielectric materials such as: Air, Teflon, high Q ceramic materials, and the like. The coaxial resonators 102*a-c* comprise a cavity containing a center conductor.

In some embodiments, the tuning elements 104*a-c* may be implemented using varactors diodes, PIN diodes, MEMS, FETs, and CMOS switches. In any case, the capacitance is changed electronically, not manually. In one possible embodiment, eight PIN diodes are used as tuning elements 104*a-c*. Though any number of tuning elements 104*a-c* may be used, depending on filtering requirements. In another embodiment, a coupling loss member 112 is integrated into the filter 100 for improving the coupling return loss. The control circuitry sends signals to turn on and off the tuning elements.

In some embodiments, the inductive coupling may be implemented using a lumped element, a high impedance TL, or through a magnetic coupling. It is significant to note that a resonator, in general, requires a 90° transmission line for coupling components thereto. Thus, the 90° TL 108 of the present invention can be implemented using a coaxial 90° TL, a Micro-strip line, a Suspended Substrate, and a Waveguide, etc. IN some embodiments, the inductive coupling may be implemented using a low loss lumped inductor or a high impedance 90° transmission line. The digital control 110 provides all the necessary stimulus for activating or deactivating the tuning elements 104*a-c*. The digital control 110 represents the digital control that sends signals to turn on or off the tunable elements.

The coaxial resonator 102*a-c* is formed by using a coaxial transmission line and a lumped capacitor. In one embodiment, the coaxial resonator 102*a-c* is configured as a high Q coaxial filter resonator. The high Q coaxial filter resonator is configured to convey frequencies across a bandwidth. By varying the voltage on the tuning elements 104*a-c*, the capacitance changes.

The change in capacitance for the tunable elements 104*a-c* enables the length of the resonators 104*a-ca-c* to be electrically lengthened and shortened. When the resonators 104*a-ca-c* electrically extend or shorten in length, a center frequency 116 in the bandwidth 114 is changed accordingly. The bandwidth 114 for the tunable band stop filter 100 is tunable to increase and decrease based on the position of the center frequency 116.

Figure 2:
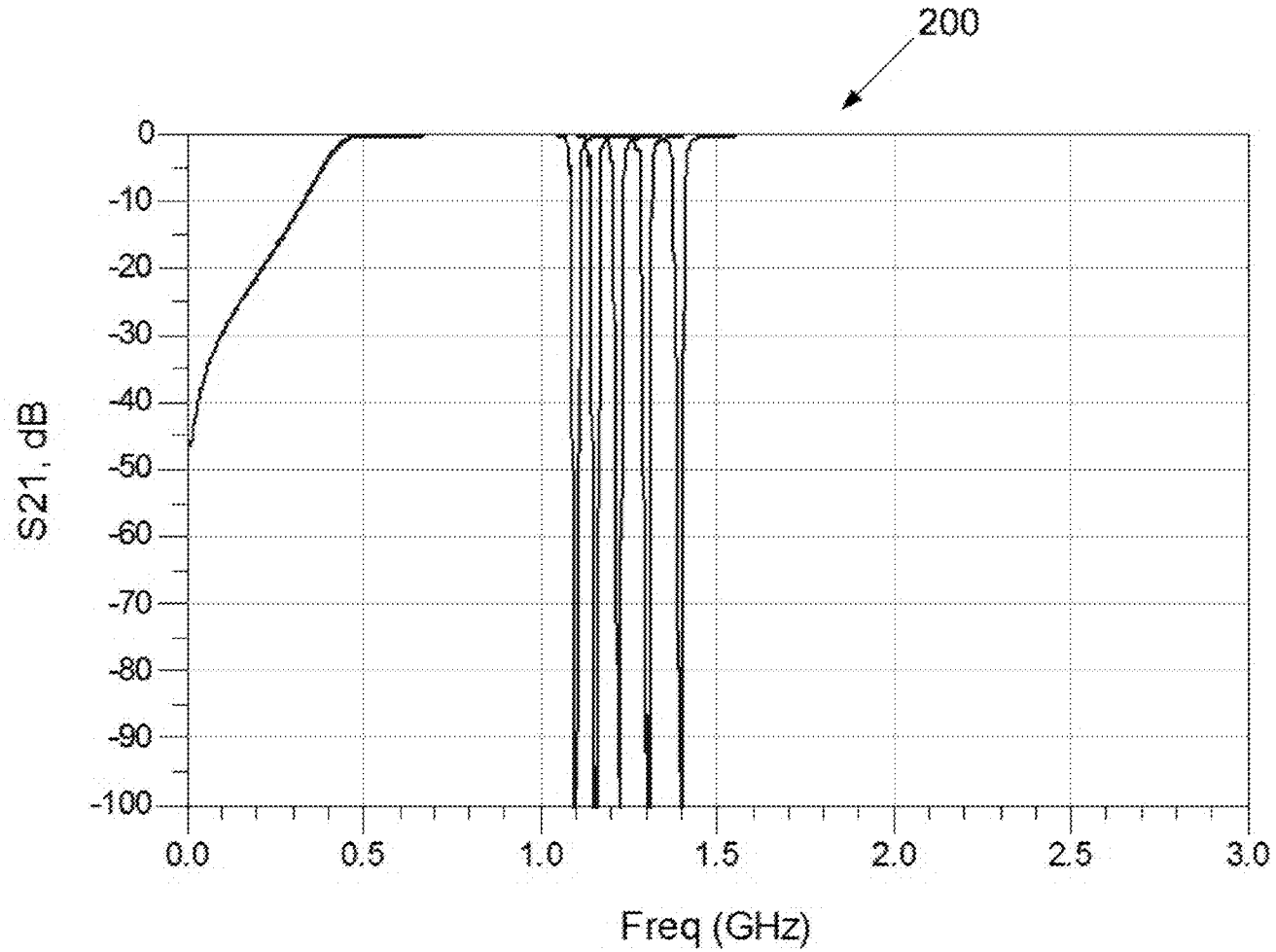
FIG. 2 illustrates a first graph response of a coaxial six resonator tunable band-stop filter, showing a high pass structure, in accordance with an embodiment of the present invention.
Figure 3:
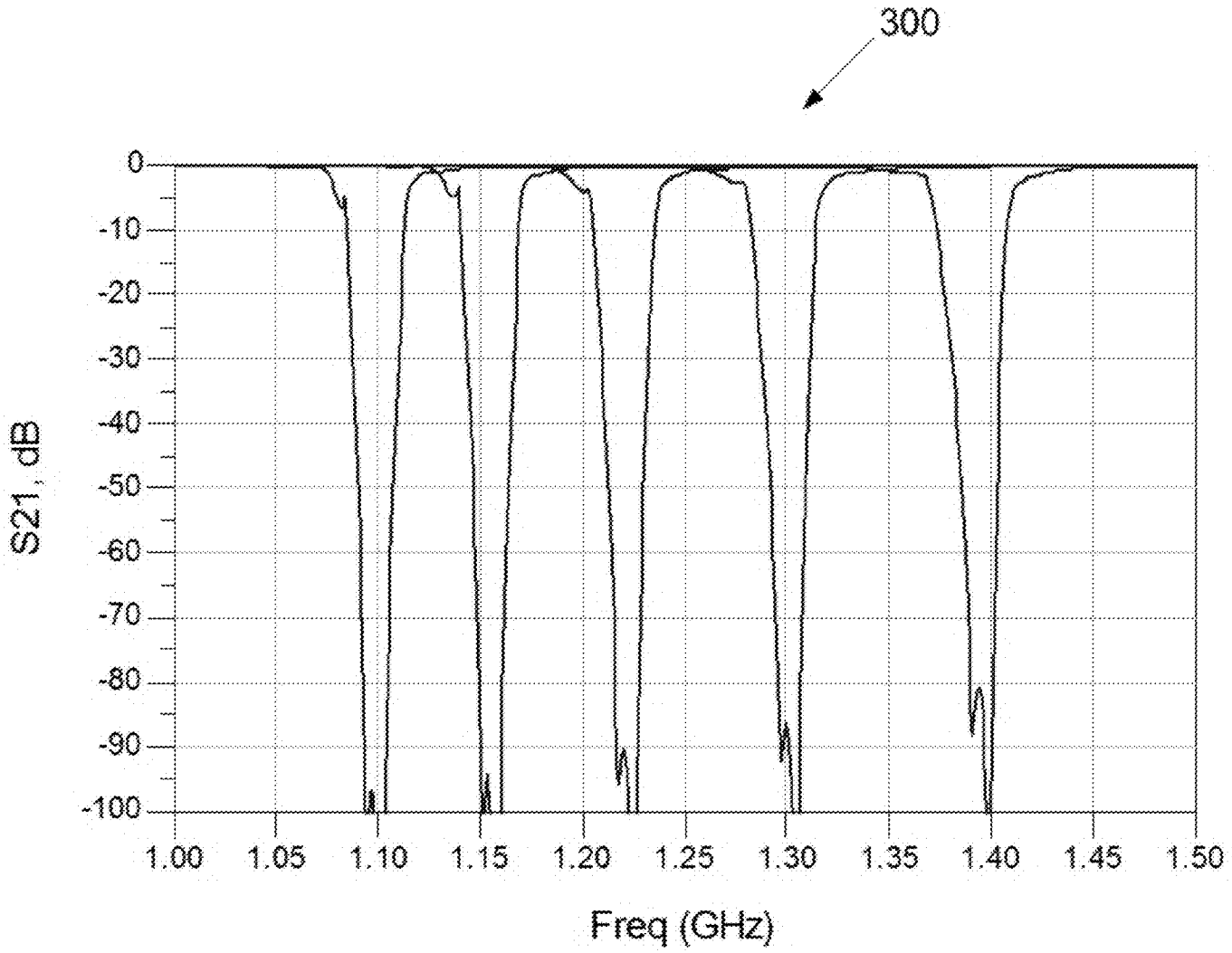
FIG. 3 illustrates the first graph response of a coaxial six resonator tunable band-stop filter, showing a high pass structure, but the band of interest is shown in more detail, in accordance with an embodiment of the present invention.

FIG. 2 shows a first graph 200 of a high pass structure. FIG. 3 shows in more detail the notch response.

The result is that, by varying the voltage on the tuning elements 104*a-c*, the capacitance of the coaxial resonator changes. By applying variable voltages to the tuning elements 104*a-c*, the length of the coaxial resonators 102*a-c* may be electrically lengthened and shortened. When the coaxial resonators 102*a-c* are electrically extended or shortened in length, the center frequency 400 in the bandwidth 402 is changed accordingly. The bandwidth 402 for the coaxial tunable band stop filter 100 is not tunable though.

The present invention differentiates from the prior art by addressing the tuning of a coaxial band stop filter 100 with a very narrow band stop, which is known in the art as a notch filter. In one possible embodiment, the tunable band stop filter 100 is a notch filter having a narrow bandwidth 402 for the frequency to pass through a passband. Specifically, the tunable band stop filter 100 is obtained with a high Q coaxial resonator which is connected to the 90° TL 108 using a low loss inductive element. The notch filter can be used in a frequency agile system for suppression of unwanted signals.

The present invention may be applied to various types of filters and their effects on frequencies, known in the art. In one embodiment, this includes a high pass filter frequency response, a low pass filter frequency response, a band pass filter frequency response, and a band stop filter frequency responses. The attenuation and the frequencies for each frequency filter are graphed in an x-y relationship. For example, the frequency response for the high pass filter, in which only frequencies above a cutoff frequency are allowed to pass. Another example includes the frequency response for the low pass filter, in which only frequencies below a cutoff frequency are allowed to pass.

The coaxial resonator 102*a-c* may include a circuit that is configured to reject frequencies in a specific band, while simultaneously admitting frequencies outside the band. The rejected frequencies inside the band are the stopband. The present invention specifically addresses tuning a band stop filter with a very narrow band stop, which is known in the art as a notch filter.

In some embodiments, the coaxial tunable band stop filter 100 tunes a range of frequencies from a VHF (30 MHz-300 MHz) to microwave frequencies. However, in one embodiment, the tunable band stop filter is configured to tune frequencies from 10 MHz through 40 GHz or more. Nonetheless, for any frequency band, the passband for the tunable band stop filter is easily varied through both analog, and digital control.

Figure 4A:
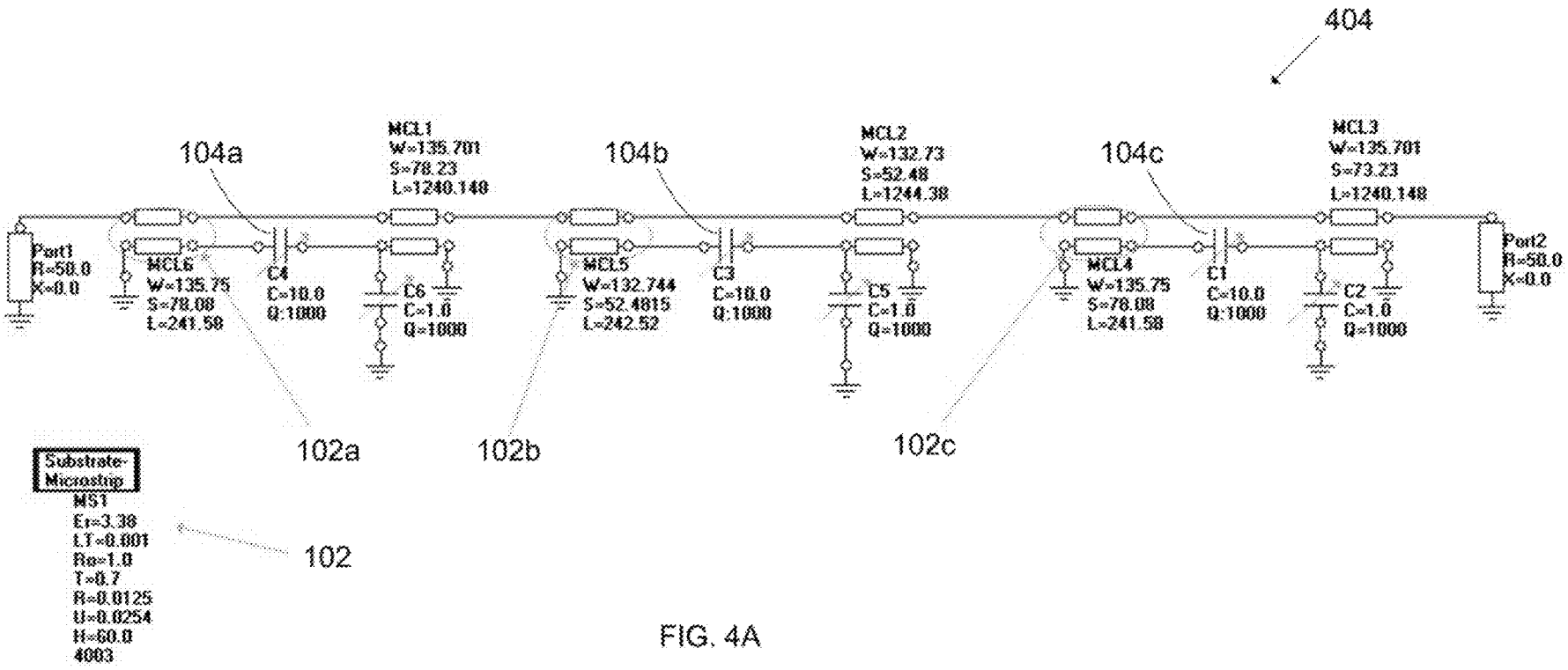
FIGS. 4A and 4B illustrate an exemplary coupled line band stop frequency filter having a plurality of resonators, where
Figure 4B:
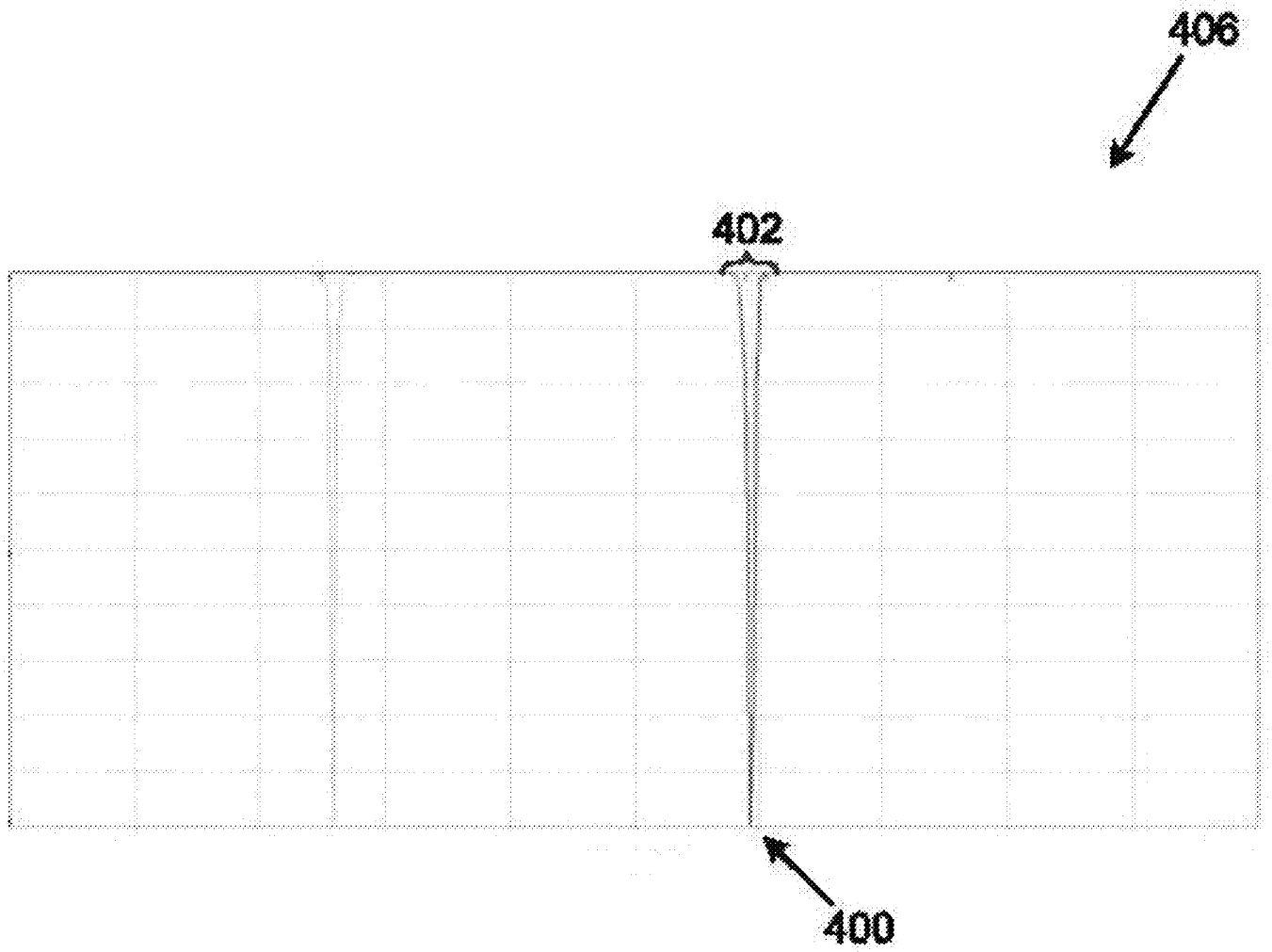

The circuit shown in FIG. 4A uses coupled lines. In one embodiment, the coaxial resonators 102*a-c* are configured to exhibit resonance behavior, oscillating at some frequencies (resonant frequencies) with greater amplitude than at other frequencies. In one embodiment, the resonators 102*a-c* increase the tuning capacity of the coaxial tunable band stop filter 100 by about 1 octave. In another embodiment, the resonators 102*a-c* are about $\lambda/4$ long. The second embodiment graph 406 depicted in FIG. 4B shows the frequency response of the coaxial tunable band stop filter 100, including the resonators 102*a-c*. Here, the frequencies 400 are centered across the bandwidth 402.

In conclusion, by varying the voltage to the tuning elements 104*a-c*, the capacitance of the coaxial resonators 102*a-c* changes. Thus, the length of the coaxial resonators 102*a-c* may be electrically lengthened and shortened. When the resonators 102*a-c* are electrically extended or shortened in length, the center frequency 400 in the bandwidth 402 is changed accordingly. The bandwidth 402 for the coaxial tunable band stop filter 100 is tunable to increase and decrease based on the position of the center frequency 400.

REFERENCES

[1] Ou, Yu-Chin, "High Performance Channelizers, Tunable Notch Filters, and Silicon-based Antennas for RF to Millimeter-wave Communication Systems", PhD thesis, UC San Diego, 2011.

[2] Jachowski, Douglas R., "Octave Tunable Lumped-element Notch Filter", Microwave Symposium Digest (MTT), June 2012.

[3] Jachowski, Douglas R., "Tunable Lumped-element Notch Filter with Constant Bandwidth", IEEE International Conference on Wireless Information Technology and Systems, September 2010.

[4] Zhengzheng Wu, Yonghyun Shim, Mina Rais-Zadeh, "Miniaturized UWB Filters Integrated With Tunable Notch Filters Using a Silicon-Based Integrated Passive Device Technology", IEEE Transactions on Microwave Theory and Techniques, vol. 60, no. 3, March 2012.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A coaxial tunable filter for varying a bandwidth of frequencies with tuning elements, the coaxial tunable filter comprising:

a plurality of coaxial resonators, the plurality of coaxial resonators configured to resonate a plurality of frequencies, the plurality of coaxial resonators further configured to electrically extend or shorten in length to vary the position of a center frequency in a bandwidth;

a plurality of tuning elements, the plurality of tuning elements disposed to attach to the plurality of coaxial resonators, the plurality of tuning elements configured to electrically lengthen and shorten the plurality of coaxial resonators when a voltage is applied to the plurality of tuning elements, wherein the bandwidth for the filter is tunable to increase and decrease based on the position of the center frequency;

a digital control, the digital control configured to electrically manipulate the plurality of tuning elements;

a ninety degree transmission line, the ninety degree transmission line configured to carry the plurality of frequencies; and an inductive coupling, the inductive coupling configured to couple the plurality of coaxial resonators and the plurality of tuning elements to the ninety degree transmission line.

2. The filter of claim 1, wherein the coaxial tunable filter is a band stop filter.

3. The filter of claim 2, wherein the band stop filter is a notch filter.

4. The filter of claim 1, wherein the plurality of frequencies range between approximately 10 MHz to 40 GHz.

5. The filter of claim 1, wherein the coaxial tunable filter comprises a printed circuit board.

6. The filter of claim 1, wherein the coaxial tunable filter is operable with inductive coupling elements.

7. The filter of claim 1, wherein the plurality of coaxial resonators are about $\lambda/4$ long.

8. The filter of claim 1, wherein the plurality of coaxial resonators are configured to increase the tuning capacity of the coaxial tunable filter by about 1 octave.

9. The filter of claim 1, wherein the plurality of tuning elements includes at least one member of the following: varactors diodes, PIN diodes, MEMs, FETs, and CMOS switches.

10. The filter of claim 1, wherein the plurality of tuning elements comprises at least eight PIN diodes.

11. The filter of claim 1, wherein applying the voltage to the plurality of tuning elements changes the capacitance.

12. The filter of claim 1 further including a coupling loss member, the coupling loss member configured to improve the coupling return loss.

13. A coaxial tunable filter for varying a bandwidth of frequencies with tuning elements, the coaxial tunable filter comprising:

a plurality of coaxial resonators, the plurality of coaxial resonators configured to resonate a plurality of frequencies, the plurality of coaxial resonators further configured to electrically extend or shorten in length to vary the position of a center frequency in a bandwidth;

a plurality of tuning elements, the plurality of tuning elements disposed to attach to the plurality of coaxial resonators, the plurality of tuning elements configured to electrically lengthen and shorten the plurality of coaxial resonators when a voltage is applied to the plurality of tuning elements, wherein the bandwidth for the filter is tunable to increase and decrease based on the position of the center frequency;

a digital control, the digital control configured to electrically manipulate the plurality of tuning elements;

a ninety degree transmission line, the ninety degree transmission line configured to carry the plurality of frequencies;

an inductive coupling, the inductive coupling configured to couple the plurality of coaxial resonators and the plurality of tuning elements to the ninety degree transmission line; and a coupling loss member, the coupling loss member configured to improve the coupling return loss.

14. The filter of claim 13, wherein the coaxial tunable filter is operable with inductive coupling elements.

15. The filter of claim 13, wherein the plurality of coaxial resonators are about $\lambda/4$ long.

16. The filter of claim 13, wherein the plurality of coaxial resonators are configured to increase the tuning capacity of the coaxial tunable filter by about 1 octave.

17. The filter of claim 13, wherein the plurality of tuning elements includes at least one member of the following: varactors diodes, PIN diodes, MEMs, FETs, and CMOS switches.

18. The filter of claim 13, wherein the plurality of tuning elements comprises at least eight PIN diodes.

19. The filter of claim 13, wherein applying the voltage to the plurality of tuning elements changes the capacitance.

20. The filter of claim 13, wherein the plurality of frequencies range between approximately 10 MHz to 40 GHz.

* * * * *